US010190343B1

(12) United States Patent
Lawrence

(10) Patent No.: US 10,190,343 B1
(45) Date of Patent: Jan. 29, 2019

(54) HOUSING PROTRUSION

(71) Applicant: Barry G. Lawrence, Thomasville, NC (US)

(72) Inventor: Barry G. Lawrence, Thomasville, NC (US)

( * ) Notice: Subject to any disclaimer, the term of this patent is extended or adjusted under 35 U.S.C. 154(b) by 0 days.

(21) Appl. No.: 15/482,094

(22) Filed: Apr. 7, 2017

Related U.S. Application Data

(63) Continuation of application No. 14/535,819, filed on Nov. 7, 2014, now Pat. No. 9,650,818.

(51) Int. Cl.

| | |
|---|---|
| ***E05C 3/04*** | (2006.01) |
| ***E05B 13/00*** | (2006.01) |
| ***E05B 15/16*** | (2006.01) |
| *E05C 3/02* | (2006.01) |

(52) U.S. Cl.
CPC ..... *E05C 3/046* (2013.01); *E05B 13/002* (2013.01); *E05B 15/1635* (2013.01)

(58) Field of Classification Search
None
See application file for complete search history.

(56) References Cited

U.S. PATENT DOCUMENTS

| | | | | |
|---|---|---|---|---|
| 744,755 | A | 11/1903 | Hasenpflug | |
| 900,079 | A | 10/1908 | Bittorf | |
| 910,850 | A | 1/1909 | Petrie | |
| 948,588 | A | 2/1910 | Kissenger | |
| 1,061,283 | A | 5/1913 | Griffin | |
| 1,122,026 | A | 12/1914 | O'Rourke | |
| 1,338,250 | A | 4/1920 | Parkes | |
| 1,899,466 | A | 2/1933 | Kistner | |
| 3,811,718 | A | 5/1974 | Bates | |
| 6,983,963 | B2 | 1/2006 | Eslick et al. | |
| 2007/0200363 | A1 | 8/2007 | Eenigenburg et al. | |
| 2008/0012358 | A1 | 1/2008 | Liang et al. | |
| 2010/0047009 | A1 | 2/2010 | McGregor | |
| 2011/0304163 | A1 | 12/2011 | Liang et al. | |
| 2013/0285391 | A1* | 10/2013 | Wolf | E05C 3/046 292/241 |

* cited by examiner

*Primary Examiner* — Alyson M Merlino
(74) *Attorney, Agent, or Firm* — Tuggle Duggins P.A.; Blake Hurt

(57) ABSTRACT

A rotatable window lock including a cam positioned within a housing and rotatably connected to a handle. The housing defines a vertical protrusion on the exterior surface sized and configured to be inserted within an aperture defined in the bottom surface of the handle. By positioning the protrusion closer to the housing edge than the housing center, the protrusion is able to rotatably refrain the handle, preventing inadvertent rotation of the handle and unauthorized window access.

20 Claims, 4 Drawing Sheets

HOUSING PROTRUSION

This is a continuation of and claims benefits under pending prior application Ser. No. 14/535,819 filed 7 Nov. 2014, now U.S. Pat. No. 9,650,818, which is incorporated by reference in its entirety herein.

FIELD OF THE INVENTION

The invention herein pertains to window hardware for allowing or preventing the displacement of sliding sash windows and particularly pertains to a hardware housing including a protrusion for preventing inadvertent rotatable displacement of a window lock handle.

DESCRIPTION OF THE PRIOR ART AND OBJECTIVES OF THE INVENTION

Window locks have long served as the threshold security devices of choice for commercial and residential structure owners attempting to protect window openings. Numerous window lock designs have been proposed in the prior art to defeat inadvertent or unauthorized window entry. The conventional window lock design includes a handle that extends above a housing that is mechanically linked to a cam, providing a user manual means for locking or unlocking a window. However, this design is also subject to clandestine access, particularly by manually attempting to rotate the cam or handle, for example with a slim jim or putty knife. Other undesirable access events may occur from natural causes, such as significant wind and driving rain. In order to more securely deploy window locks, significant mechanical features may be utilized. However, these mechanisms are complex, expensive, and want to inadvertently obstruct authorized window use. Therefore, there exists a need for a secure window lock that can be easily manufactured and operated.

Thus, in view of the problems and disadvantages associated with prior art window hardware devices, the present invention was conceived and one of its objectives is to provide a window lock with a handle restraint.

It is another objective of the present invention to provide a window lock with a housing defining a protrusion that mechanically prevents inadvertent handle rotation.

It is still another objective of the present invention to provide a window lock that is efficient to manufacture and simple to use.

It is yet another objective of the present invention to provide a window lock with a housing defining an arcuate protrusion capable of releasably restraining a lock handle.

It is a further objective of the present invention to provide a window lock with a housing defining a protrusion that is positioned more distal to the handle attachment point than proximal.

It is still a further objective of the present invention to provide a window lock with a housing defining a protrusion configured to be received within a recess defined by the handle.

It is yet a further objective of the present invention to provide a window lock with a housing defining a peaked protrusion for insertion within the handle.

Various other objectives and advantages of the present invention will become apparent to those skilled in the art as a more detailed description is set forth below.

SUMMARY OF THE INVENTION

The aforesaid and other objectives are realized by providing a window lock including a domed lock housing defining a protrusion positioned on the housing exterior surface. The housing contains a cam that serves to mechanically engage a keeper to secure a window opening. A handle with a post that passes vertically through a central aperture in the housing is in rotatable communication with the cam, allowing a user to lock or unlock a window as would be understood. The protrusion defines an arcuate longitudinal shape sized to be inserted into a recess defined in the bottom of the handle. In use, a user rotates the cam via the handle from a first, unlocked position to a second, locked position. The handle passes over the protrusion and receives it within the recess defined in the handle bottom. The handle is restrained in this position and may not rotate in the direction of the first position without significant, intentional rotation by an authorized user.

DETAILED DESCRIPTION OF THE PREFERRED EMBODIMENT AND OPERATION OF THE INVENTION

Figure 1:
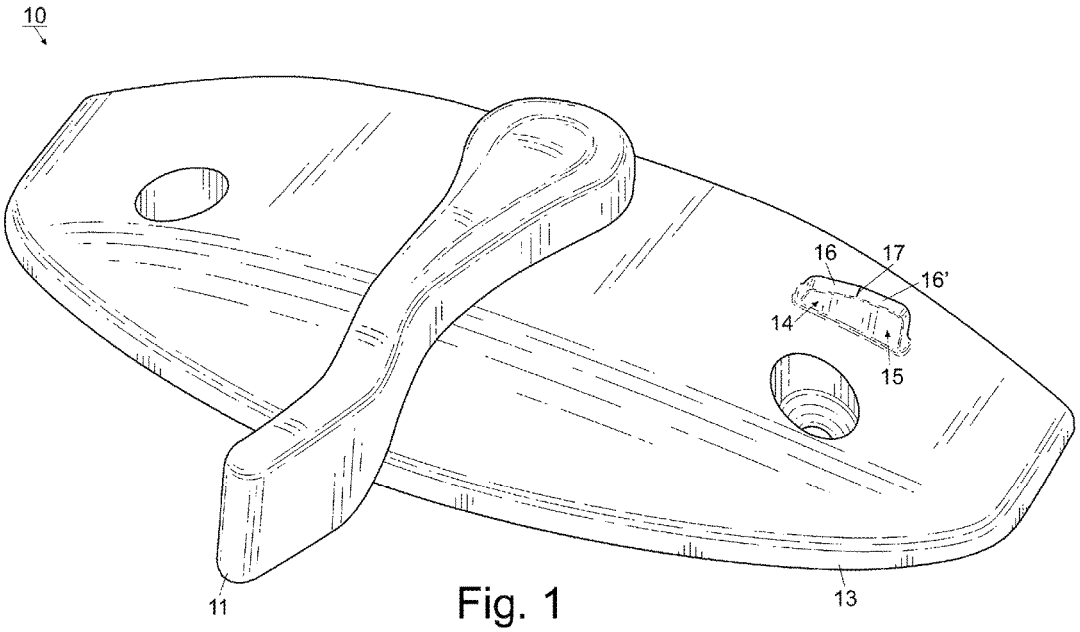
FIG. 1 pictures a rear elevated perspective view of the window lock in a partially locked position.

For a better understanding of the invention and its operation, turning now to the drawings, FIGS. 1-4 illustrate preferred window lock 10 including handle 11 in rotatable communication with cam 12, positioned within housing 13. As demonstrated in FIGS. 1, 2, and 4, preferred housing 13 defines vertical protrusion 14 arising substantially perpendicularly on an exterior surface of housing 13. Although preferred protrusion 14 is integrally formed with the exterior surface of housing 13, for example by molding, alternate embodiments of protrusion 14 may be manufactured as separate components and added to existing housing 13, for example with adhesive, fasteners, and the like. Housing 13 and protrusion 14 are preferably formed out of a polymeric material, such as nylon, as it defines a structural stable base for a window lock while simultaneously imbuing window lock 10 with a flexible quality that will be described further below. It should be understood that other materials that define these characteristics may be equally suitable and thus are within the scope of the instant invention.

FIG. 1 illustrates a rear elevated perspective view of window lock 10 with handle 11 and cam 12 in a partially locked position (i.e. in a one hundred eighty degree (180°) rotation, zero degrees (0°) and one hundred eighty degrees (180°) rotation indicate fully locked and fully unlocked positions, whereas ninety degrees (90°) rotation indicates a partially unlocked position). In this position, handle 11 is oriented perpendicularly to the longitudinal axis of housing 13 and cam 12 is not entirely rotationally engaged with a keeper (not shown). Handle 11 is represented in FIGS. 1-4 as defining a broad end distal housing 13, a curved or arcuate middle section and a broad, circular end proximate housing 13. However, the design of handle 11 is not intended to be a limiting feature of the instant invention, and alternative embodiments of handle 11 are within the scope of window lock 10. FIG. 1 also shows rear face 15 (rearward facing relative to cam 12) of protrusion 14. Rear face 15 defines a planar surface extending vertically from housing 13. Rear face 15 may also include beveled top edges 16, 16', beveled edge 16 positioned on protrusion 14 more proximal the center of housing 13 and beveled edge 16' located on protrusion 14 more distal of the same point, and opposingly attached to front face 20 (shown in FIG. 2). As mentioned previously and shown throughout the figures, the components of protrusion 14 such as rear face 15 and top beveled edges 16, 16' are integrally formed with housing 13 and preferably arise seamlessly therefrom. Top beveled edges 16, 16' may join to form the top of protrusion 14 in a number of configurations, but the preferred configuration aligns edges 16, 16' to form peaked point 17 (edges 16, 16' declining from peaked point 17 by about ten degrees (10°) but nothing in this disclosure requires edges 16, 16' to define the same slope). An embodiment of protrusion 14 may include top beveled edge 16' that defines a width that is narrower than a width defined by top beveled edge 16 to permit greater frictional clearance for handle 11. Such an orientation is preferred for the reasons discussed further below and may be configured to rotatably restrain handle 11.

Figure 2:
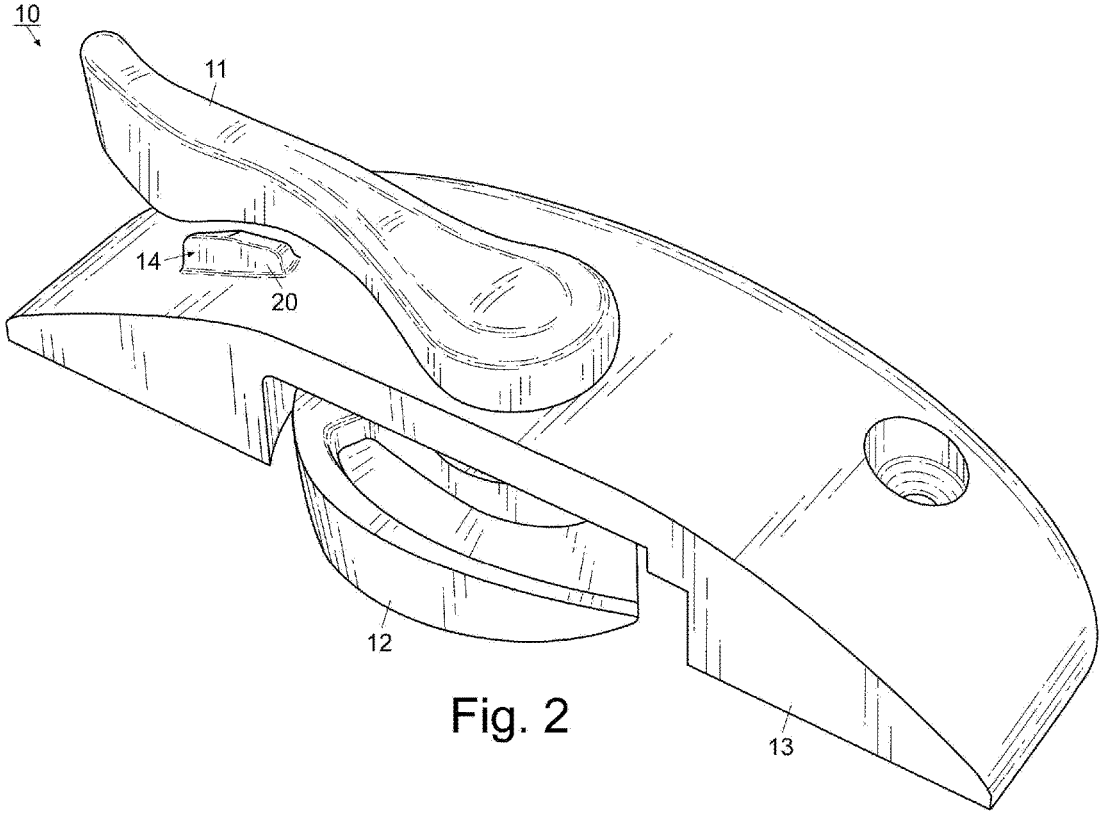
FIG. 2 shows a front elevated perspective view of a window lock in a mostly locked position.
Figure 3:
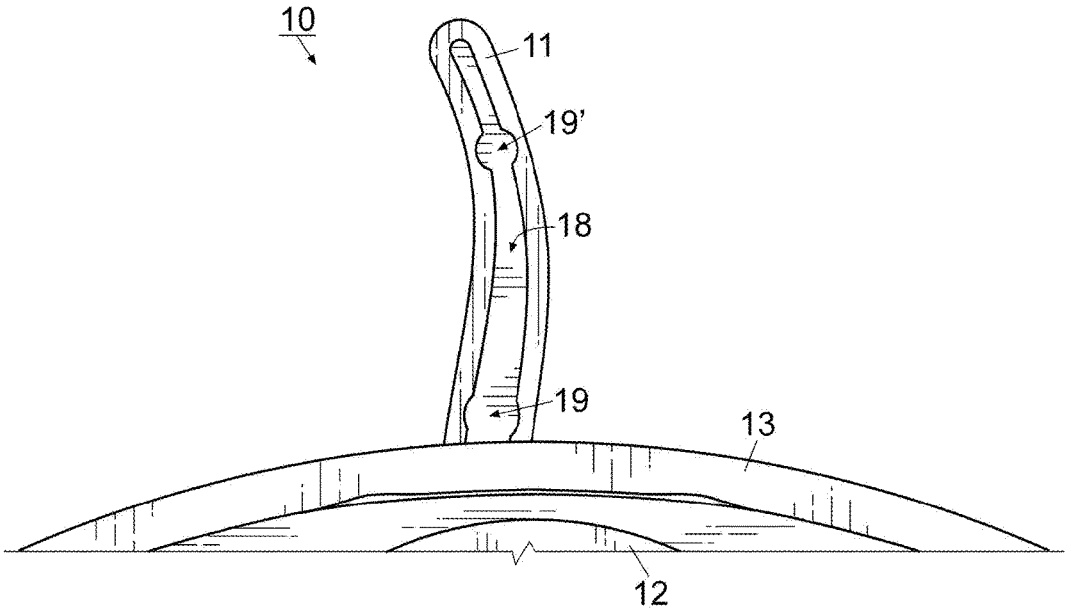
FIG. 3 depicts a bottom plan view of the window lock of FIG. 1.
Figure 4:
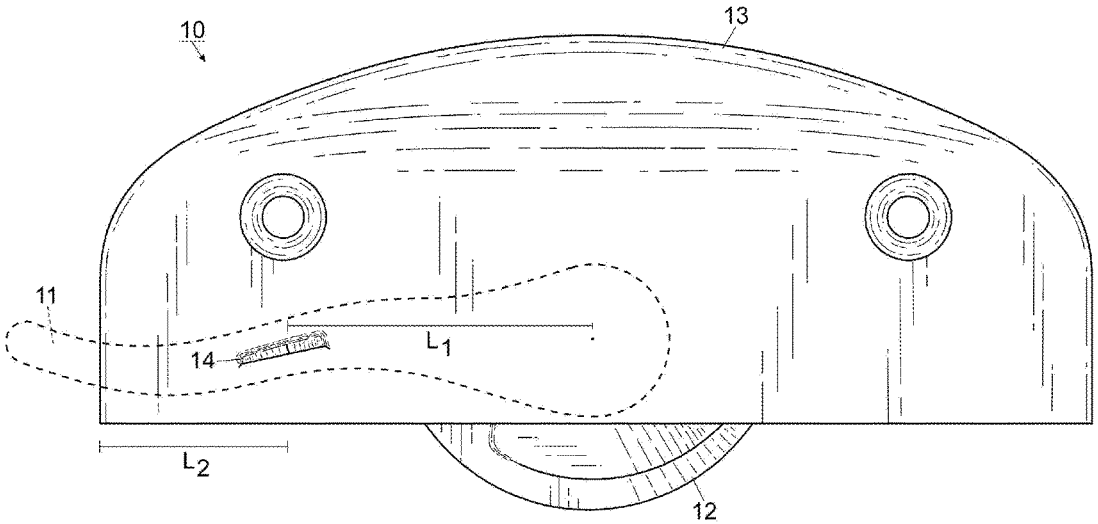
FIG. 4 demonstrates a top plan view of the window lock in a locked position.

FIG. 2 shows a front elevated perspective view of window lock 10 with handle 11 and cam 12 in a mostly locked position, orienting handle 11 in close proximity to protrusion 14. As handle 11 and cam 12 are rotated into the fully locked position as illustrated in FIG. 4, the resilient nature of the material forming protrusion 14 and handle 11 combine to create sufficient vertical displacement or flexion of handle 11, allowing protrusion 14 to pass underneath handle 11 and nest within handle aperture 18 as demonstrated in FIG. 3. Preferred handle 11 defines longitudinal handle aperture 18 in the bottom surface, laterally sized to receive the lateral width of protrusion 14. An embodiment of handle aperture 18 may include circular widening 19, as the curvature of handle 11 follows a slight arcuate shape formed by protrusion 14, and circular widening 19 permits accommodation of peaked top 17 while also securing handle 11 from inadvertent displacement, for example in the case of inclement weather or home invasion.

FIG. 4 demonstrates a top plan view of window lock 10 with cam 12 and handle 11 (illustrated in dotted fashion) positioned in a locked position, with protrusion 14 nested within handle aperture 18. Preferred window lock 10 includes protrusion 14 positioned further away from the attachment point of handle 11 to housing 13 (this distance is represented in FIG. 4 as $L_1$) and closer to the exterior edge (longitudinally) of housing 13 (this distance is represented in FIG. 4 as $L_2$). In the most preferred embodiment of window lock 10, $L_1$ is significantly greater than $L_2$, for example $L_1$ may be double the distance of $L_2$. $L_1$ may be measured from the center of the attachment point of handle 11 and housing 13 to the middle of protrusion 14 while $L_2$ is measured from the exterior edge of housing 13 to the center point of protrusion 14.

A method of securing window lock handle 11 includes the steps of providing window lock 10 with handle 11 rotatably affixed to cam 12 and housing 13 defining protrusion 14 on the exterior surface of housing 13. As handle 11 and cam 12 are rotated from an unlocked position to a locked position, handle 11 flexibly displaces vertically over protrusion 14, permitting protrusion 14 to nest within handle aperture 18 defined in the bottom of handle 11. Protrusion 14 restrains handle 11 from inadvertent rotation until a user desires to position window lock 10 in the unlocked position.

In an alternate embodiment of lock 10, handle 11 may not define aperture 18 configured to receive protrusion 14, for example should handle 11 be formed with a solid construction (not shown). This alternate embodiment of lock 10 may be provided as described above, and handle 11' (not shown) and cam 12 may rotate from an unlocked position to a locked position, causing handle 11' to vertically displace over protrusion 14, orienting the rear face 15 of protrusion 14 frictionally engaged to the rear surface of handle 11', preventing inadvertent rotation as previously described. This feature is a function of the material forming embodiments of handle 11 combined with the geometry of protrusion 14, which allows sufficient vertical displacement and rotational engagement of embodiments of handle 11 to rise above protrusion 14 and nest protrusion 14 either within aperture 18 or abutting rear face 15 as described.

The illustrations and examples provided herein are for explanatory purposes and are not intended to limit the scope of the appended claims.

I claim:

1. A window lock comprising a housing and a handle, the housing defining a protrusion extending vertically from an exterior surface of the housing and configured to rotatably restrain the handle, the protrusion defining a pair of beveled top edges, wherein a distance from an attachment point of the handle to the housing and a middle of the protrusion is considered as $L_1$, wherein a distance from an exterior edge of the housing to the middle of the protrusion is considered as $L_2$, and wherein $L_1$ is greater than $L_2$, and wherein the handle vertically displaces from a first plane of rotation to a second plane of rotation to vertically clear the protrusion before returning to the first plane of rotation.

2. The window lock of claim 1 wherein the handle defines an aperture.

3. The window lock of claim 2 wherein the aperture is sized to receive the protrusion therein so as to rotatably restrain the handle.

4. The window lock of claim 3 further comprising a circular opening defined by the aperture.

5. The window lock of claim 1 wherein the pair of beveled top edges join to form a peak.

6. A window lock comprising a housing, a cam positioned within the housing and rotatably attached to a handle, the housing defining a vertically extending protrusion configured to rotatably restrain the handle, the protrusion including a pair of beveled top edges, wherein a distance from an attachment point of the handle to the housing and a middle of the protrusion is considered as $L_1$, wherein a distance from an exterior edge of the housing to the middle of the protrusion is considered as $L_2$, and wherein $L_1$ is greater than $L_2$, and wherein the handle vertically displaces from a first plane of rotation to a second plane of rotation to clear the protrusion before returning to the first plane of rotation.

7. The window lock of claim 6 wherein an aperture defined in the handle is sized to receive a lateral width of the protrusion therein so as to rotatably restrain the handle.

8. The window lock of claim 7 further comprising a circular opening defined by the aperture.

9. The window lock of claim 6 wherein the pair of beveled top edges join to form a peak.

10. The window lock of claim 6 wherein the protrusion is defined by opposing front and rear faces attached to a pair of beveled top edges joined to form a peak.

11. The window lock of claim 10 wherein the front and rear faces are planar.

12. The window lock of claim 11 wherein the protrusion is positioned further away from a center of the housing, and closer to a longitudinal edge of the housing.

13. The window lock of claim 6 wherein the window lock is formed from a polymeric material.

14. The window lock of claim 13 wherein the polymeric material is nylon.

15. A window lock comprising a housing and a handle, the housing defining a protrusion extending vertically from an exterior surface of the housing and configured to rotatably restrain the handle, the protrusion defined by opposing front and rear faces attached to a pair of beveled top edges joined to form a peak, wherein a distance from an attachment point of the handle to the housing and a middle of the protrusion is considered as $L_1$, wherein a distance from an exterior edge of the housing to the middle of the protrusion is considered as $L_2$, and wherein $L_1$ is greater than $L_2$, and wherein the handle vertically displaces from a first plane of rotation to a second plane of rotation to vertically clear the protrusion before returning to the first plane of rotation.

16. The window lock of claim 15 wherein the protrusion defines an arcuate shape.

17. The window lock of claim 15 wherein the protrusion is positioned further away from a center of the housing, and closer to a longitudinal edge of the housing.

18. The window lock of claim 15 wherein the handle defines an aperture sized to receive the protrusion therein so as to rotatably restrain the handle, and further comprising a circular opening defined by the aperture.

19. The window lock of claim 15 wherein the window lock is formed from a polymeric material.

20. The window lock of claim 19 wherein the polymeric material is nylon.

* * * * *